United States Patent [19]

McLean

[11] 4,093,154

[45] June 6, 1978

[54] TARGET SEEKING GYRO FOR A MISSILE

[75] Inventor: William B. McLean, China Lake, Calif.

[73] Assignee: Walter G. Finch, Baltimore, Md. ; a part interest

[21] Appl. No.: 583,337

[22] Filed: May 7, 1956

Related U.S. Application Data

[63] Continuation of Ser. No. 337,899, Feb. 19, 1953, abandoned.

[51] Int. Cl.[2] ..... F42B 13/28; F41G 7/10; G01C 19/28; G01C 19/53

[52] U.S. Cl. ..... 244/3.16; 74/5.46; 250/203 R; 250/204

[58] Field of Search ..... 88/1; 250/203, 204; 74/5.4; 343/118; 102/50; 201/635 EC; 244/3.16

[56] References Cited

U.S. PATENT DOCUMENTS

| | | | |
|---|---|---|---|
| 1,388,932 | 8/1921 | Centervall | 318/480 |
| 1,412,453 | 12/1946 | Grimslaw | 308/201 |
| 2,423,885 | 7/1947 | Hammond | 244/143 |
| 2,517,702 | 8/1950 | Offner | 343/118 |
| 2,695,165 | 11/1954 | Hansen | 250/201 |
| 2,705,274 | 3/1955 | Buck | 201/635 EC |
| 2,707,400 | 5/1955 | Manger | 74/5.4 |
| 2,762,123 | 9/1956 | Schultz et al. | 33/1 |
| 2,866,146 | 12/1958 | Rodriguez, Jr. | 102/50 |
| 2,935,942 | 5/1960 | De Young | 102/3 |
| 2,948,813 | 8/1960 | Osborne | 250/203 |

FOREIGN PATENT DOCUMENTS

| | | | |
|---|---|---|---|
| 33,746 | 10/1934 | Netherlands | 250/203 |

*Primary Examiner*—Samuel W. Engle
*Assistant Examiner*—Thomas H. Webb
*Attorney, Agent, or Firm*—R. S. Sciascia; R. Miller

EXEMPLARY CLAIM

37. In combination in a missle guidance system, a target seeking apparatus having radiation responsive means including a scanner, a gyroscope having a rotor, said scanner being mounted on said rotor for picking up radiation from a target, means for precessing said gyroscope rotor to align its axis with the sight line to said target, said radiation responsive means producing a signal when the gyroscope rotor axis deviates from alignment with the sight line to said target, said signal having a time phase dependent on the radial direction of departure of said target from the gyro rotor axis, the precessing means embodying mechanism responsive to the phase of said signal whereby said gyro is precessed in the proper sense to align its axis with the line of sight to said target, a position sensing means included in said target seeking apparatus and mounted adjacent said gyro rotor for sensing the position of said gyro rotor, and servo means responsive to signals from said gyro rotor position sensing means for guiding said missile.

38. A target seeking device for a guided missile comprising a gyroscopically stabilized means for optically scanning a limited region about a first coordinate axis for electromagnetic radiations emanating from a target source, said means including a permanent magnet rotor rotatable with said gyroscopic means about said first axis, the magnetic poles of said permanent magnet defining a second coordinate axis transverse to said first coordinate axis, a radiation sensitive means for producing electrical signal variations in response to variations in radiation incident on said radiaton sensitive means, said radiation sensitive means being fixedly positioned relative to said scanning means for receiving said radiations from said scanning means to cause said electrical signals generated thereby to vary in magnitude with the directional displacement of said target with respect to said first coordinate axis and in time phase with the polar angular position of said target with respect to the second coordinate axis, and means interacting with said permanent magnet rotor responsive to said signal for applying a magnetic force to said gyroscopically stabilized means having a component normal to said second axis and in a direction causing said gyroscopically stabilized means to precess through an angle and in a direction to bring said first coordinate axis into directional alignment with said target source.

38 Claims, 10 Drawing Figures

Fig. 1.
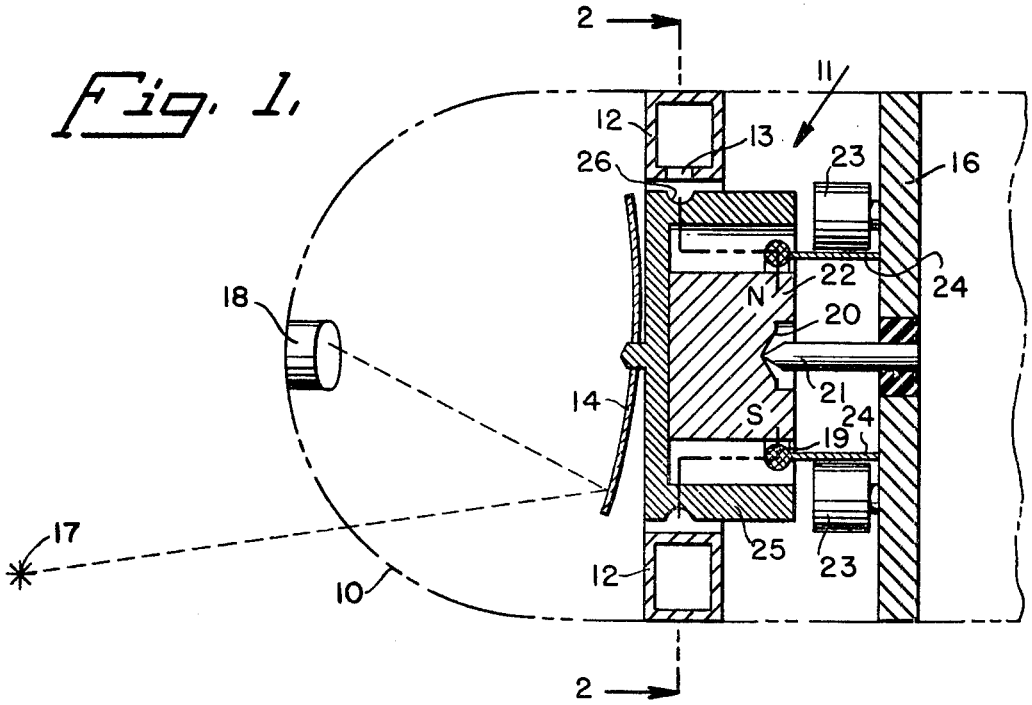
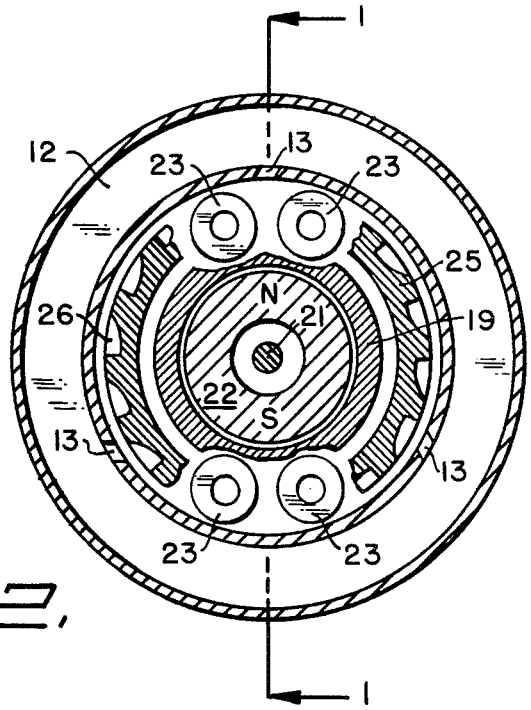
Fig. 2.

TARGET SEEKING GYRO FOR A MISSILE

The invention described herein may be manufactured and used by or for the Government of the United States of America for governmental purposes without the payment of any royalties thereon or therefor.

This application is a continuation of application Ser. No. 337,899 filed in the U.S. Patent Office on Feb. 19, 1953 now abandoned.

The present application is related to my application Ser. No. 316,819 for a Guided Missile, filed Oct. 24, 1952, a continuation of which was filed May 24, 1957, Ser. No. 661,549.

This invention relates to a homing missile and especially a quasi-optical target-seeking device of the type adapted to automatically direct or point itself at a source of electromagnetic radiation such as a source of infrared radiation. The the target seeker of the present invention is a radiation responsive device which will track a moving target from which radiation is emanating. The seeker may be utilized, for example, to steer an air-to-air missile or the like along a course calculated to cause the missile to collide with a target, such as jet aircraft tailpipes or exhaust stacks on a propeller type plane which are sources of infrared energy.

The invention is concerned primarily with improvements in a gyro stabilized target seeker device that continuously tracks a target. To do this, the target seeker device must measure the angular difference, or error, between a line taken along the axis of rotation of the rotor of a free gyro which forms a portion of the target seeker device and the line of sight between the target seeker and the target and use this information to cause the gyro rotor to be precessed so that the axis of rotation of the gyro rotor, or the gyro axis, and the line of sight between the target seeker device and the target coincide. When the target seeker device is utilized in an air-to-air guided missile, for example, it is mounted at the forward end, or head of the missile with its longitudinal axis along the longitudinal axis of the missile, and the measurement of the angular difference between the gyro axis and the longitudinal axis of the missile is utilized to control the course along which the missile is steered. In addition to having means for measuring the angular difference between the gyro axis and the line of sight between the target seeker and the target, the seeker device or seeker head also embodies means for sensing angular differences between the gyro axis and the longitudinal axis of the missile. Such difference between the gyro axis and the longitudinal axis of the missile is sensed in the form of electrical signals which are amplified and utilized to control and move fins on the missile whereby the missile is directed toward the target.

The gyro rotor which forms a part of the seeker head mechanism carries a permanent magnet which rotates with it and a rotating focusing mirror which reflects an image of the target. The mirror is inclined at a slight angle to the axis of the gyro so that the target image reflected by the mirror travels in a circle. When the line of sight from the seeker head to the target and the gyro axis coincide, or the target lies on the gyro axis, the reflected image of the target at a radiant energy device (such as a photoelectric cell, which is mounted on the longitudinal axis of the seeker head and which forms a component of the seeker head) revolves around but does not fall upon the cathode of the radiant energy device. When the target does not lie directly on the gyro axis, but is off by a small amount, the circular path traveled by the reflected target image passes across the cathode of the radiant energy device to produce an electrical signal, the frequency of the signal equaling the spin frequency of the gyro rotor.

The permanent magnet is fixedly mounted on the rotor of the gyro so that a relationship exists between the position of the poles of the permenent magnet and the signal produced by the radiant energy device when there is an angle between the gyro axis and the line of sight between the seeker head and the target. To eliminate the angle, the gyroscope is precessed by the interaction between the magnetic field of the permanent magnet and the magnetic field of a surrounding non-rotating electrical winding, or precessing coil. The amplified output of the radiant energy device is applied across the precessing coil so that the interaction between the magnetic field of the permanent magnet and the magnetic field of the precessing coil produces a precessing torque on the gyro which is of the proper sense to correct, or eliminate, the angle between the gyro axis and the line of sight from the seeker head to the target. In other words, when the reflecting mirror is properly related to the positions of the poles of the permanent magnet, the poles, during spin, are angularly oriented relative to the periodic magnetic field of the coil (produced by the signal pulses energizing the coil) in such a manner that, as a result of interaction between the magnet and periodic magnetic field, a torque is applied to the spinning magnet which will cause the gyro to precess in a straight line to align the gyro axis with the line of sight from the seeker head to the target and the angle therebetween is thus eliminated.

The gyro of this invention is not mounted in gimbals but rotates and precesses about a single, central universal bearing, whereas, in previous devices it was necessary to resolve the error signal into two components and to then precess the gyro about its two gimbal axes. In previous devices the scanning, resolving, and gyro elements have been separate units, while in the present invention the scanning, resolving, and gyro elements are embodied in a single unit, thus considerably simplifying the apparatus and making it capable of tracking a target even under the condition of high roll rates of its supporting structure.

Similar systems known to the prior art have been subject to the disadvantage that the tracking takes place in two dimensions with the signal being resolved into two components, one for each dimension. In the present invention the tracking takes place in two dimensions without the necessity of revolving the signal into components for two coordinates and without the activation of two separate amplifiers, servos, or synchros, etc. That is, the permanent magnet and scanning mirror, which spin together gyroscopically about the gyro axis, are fixed to each other in such relation that the signal (produced when the gyro axis does not coincide with the line of sight) can be applied through a single amplifier and coil to the magnet in order to cause the magnet to precess and the gyro axis to align itself with the source of radiation; thus, only one coil and amplifier is needed in contradistinction to the two coils and amplifiers of precession mechanisms requiring resolution of tracking signals into two components. This is an extremely important feature when the system is mounted in a missile. In the prior art systems, the gyro is mounted in gimbals and the signals to precess the gyro are resolved with respect to the orientation of these gimbals. If the missile rolls about its longitudinal axis, these signals must change rapidly as the gimbal axis changes in order to keep the precession signal in the proper direction. In addition, in prior systems, the rolling of the missile in itself causes torques to be applied to the gyro; this is not true in the present invention. In the present invention the precessing means is such that the roll of the missile has no effect on the signal required to keep the gyro tracking the target. The single universal bearing support used for the gyro in the present invention permits swiveling or rotation (movement) at any angle within definite limits; this feature is important in a gyro subject to high inertial forces, and in that it gives freedom from critical balance tolerances and materially enhances ease of production and reliability of operation. The seeker device, or seeker head of the present invention is mounted on the forward end of a missile for the purpose of guiding the missile. The longitudinal axis of the seeker head is mounted so that its axis coincides with the longitudinal axis of the missile. In other words, the seeker head becomes the forward part and guidance portion on the missile. The warhead and propulsion system of the missile are rearward of the seeker head.

In the seeker head of the present invention the gyro rotor is mounted on a single central pivot bearing, and the precessing torque is not resolved into two separate components. The precessing torque is applied without physical connection between the gyro rotor and the precessing means. This is achieved by interaction between the magnetic field periodically produced by the fixed electrical winding of the precessing coil and the magnetic field of the movable permanent magnet carried by the gyro rotor. The time at which the signal pulses are applied across the precessing winding is related to the angular position of the north-south pole axis of the permanent magnet with respect to the precessing coil so that the interaction between the field of the permanent magnet and the field resulting from the current in the precessing coil produces a precessing torque on the gyro in exactly the right sense to realign the gyro axis with the line of sight between the seeker head and the target. Parenthetically, it may be said that in an infrared homing missile it is advantageous to use a sight-line telescope assembly having a relatively narrow field of view. It is desired that the seeker head keep the target in view when the missile oscillates; this is accomplished by the preferred embodiment of the invention. Accordingly, the significance of this invention is apparent in that the viewing system is stabilized so as to be independent of missile oscillations.

A primary object of the invention is, accordingly, to provide a gyro stabilized telescope for tracking a target or the like wherein the gyro axis is caused to continuously point at the target.

Another object is to provide a tracking apparatus as in the foregoing wherein the gyro is realigned, relative to the line of sight of the apparatus, by being precessed by means of interacting magnetic forces.

Another object is to provide a tracking device as in the foregoing wherein the direction of precession of the gyro in the proper sense is achieved by the relationship between electrical signal pulses generated as a result of deviation of the line of sight between missile and target from the gyro axis in a given direction, and the angular position of a permanent magnet carried by the gyro rotor.

Another object is to provide an automatic tracking device or target seeker for a homing missile comprising a gyro stabilizer embodying a rotor mounted on a single central pivot, so as to be free to be precessed in two dimensions, simultaneously for tracking a target emitting electromagnetic radiation.

Another object of the invention is to provide an automatic, radiation-responsive tracking device or target seeker operative to simultaneously track a target and measure the angular difference between the line of sight and the longitudinal axis of the device.

Another object of the invention is to provide a target seeker as in the foregoing object wherein electrical means are associated with the rotor and magnet for measuring the precessed position of the gyro axis for use in controlling the course of travel of a vehicle with reference to the line of sight from the vehicle to a target.

Further objects and numerous advantages of the invention will become apparent from the following detailed description and annexed drawings wherein:

FIG. 1 is a diagrammatic view of the forward section of a seeker assembly illustrating operation of the invention and shown in its relationship to the forward part of an air-to-air missile;

FIG. 2 is a cross sectional view taken along line 2—2 of FIG. 1;

Referring to FIG. 1 of the drawings, this figure is a schematic view of a fragmentary showing of the seeker device to most simply illustrate the principle of its operation; the various parts are shown in their relative position to each other, however, some supporting structure is not shown in order to more simply show the operational parts of the device. Numeral 10 represents the nose of a missile, the forward part of the nose being transparent to allow the movable optical portion of the seeker head to scan a target. The gyro rotor is shown at 11 and, as may be seen, it is within a circular air manifold 12. The gyro rotor is pneumatically driven by air discharging through jets 13, shown in FIG. 2. The rotor carries a mirror as shown at 14 which is mounted at a small angle to the axis of the gyro and this angle may be $2\frac{1}{2}°$, for example. However, other angles may be used depending upon the desired position and size of the other components in the seeker device. The gyro rotor, magnet and mirror form the movable optical portion of the seeker head.

In FIG. 1, numeral 17 designates a target which may be any source of radiation of light, heat or infrared rays, such as a jet airplane tailpipe. Numeral 18 designates diagrammatically a photocell or other radiation responsive device which receives the target signal.

Figure 3:
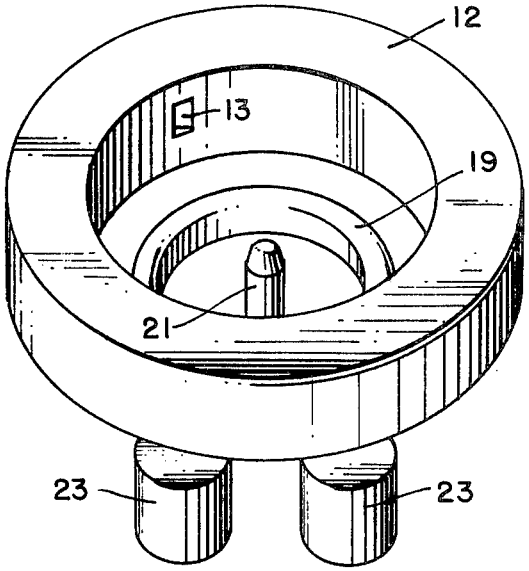
FIG. 3 is a perspective view of a part of the assembly.
Figure 9:
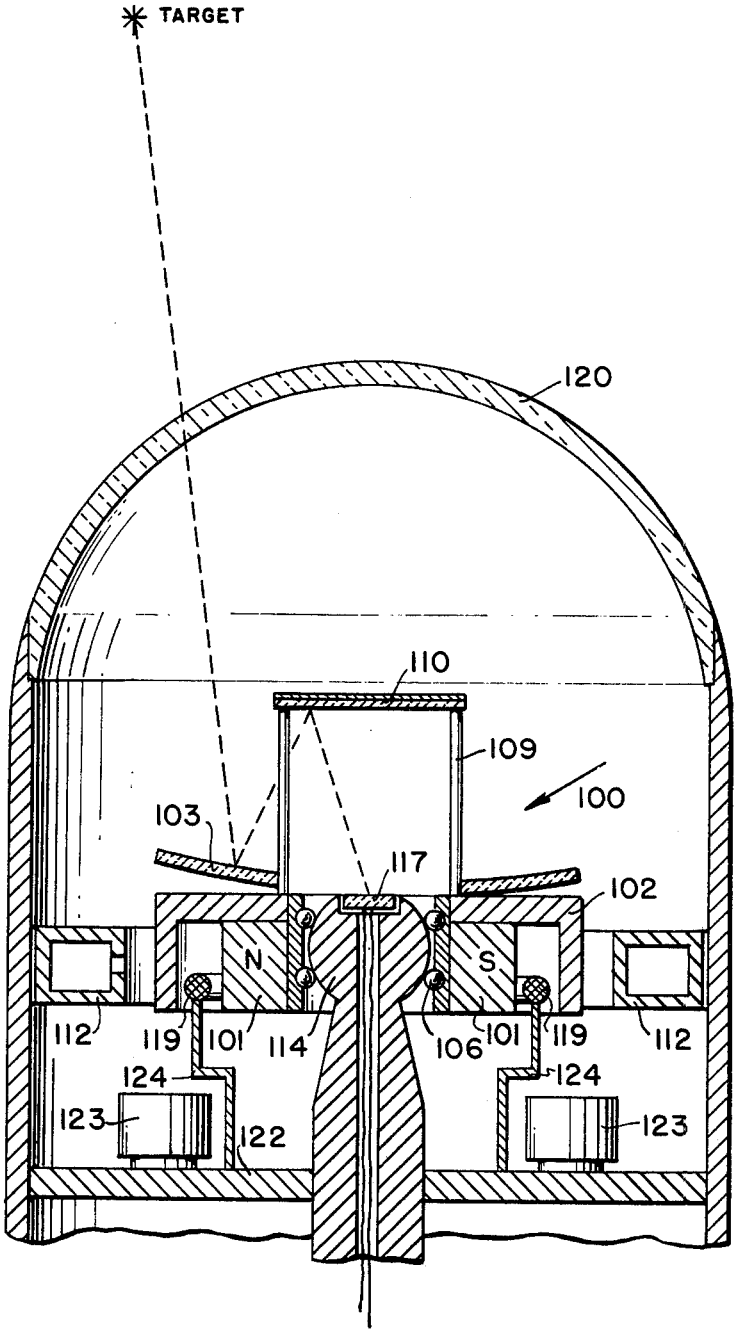
FIG. 9 is a diagrammatic view of a preferred form of the invention.

Referring now to FIGS. 1, 2 and 3 of the drawings, numeral 19 designates the precessing coil, which is mounted on the gyro frame 16 by supports 24 and surrounds the rotating magnet 22, as will be explained more in detail presently. Numeral 20 designates the central bore or support for the rotor 11, engaging a central pivot point as shown at 21, aligned with the rotor axis whereby the rotor is free to rotate and be precessed with two degrees of freedom. Bore 20 and pivot 21 are shown for illustrative purposes only; in actuality a universal bearing, as shown in FIG. 9 for example, or miniature gimbals would be used. The air manifold 12 has three internal angularly spaced jets 13, as shown, whereby air or gas under pressure is discharged inwardly against scallops 26 on the rotor 11, for rotating it at high speed.

Figure 7:
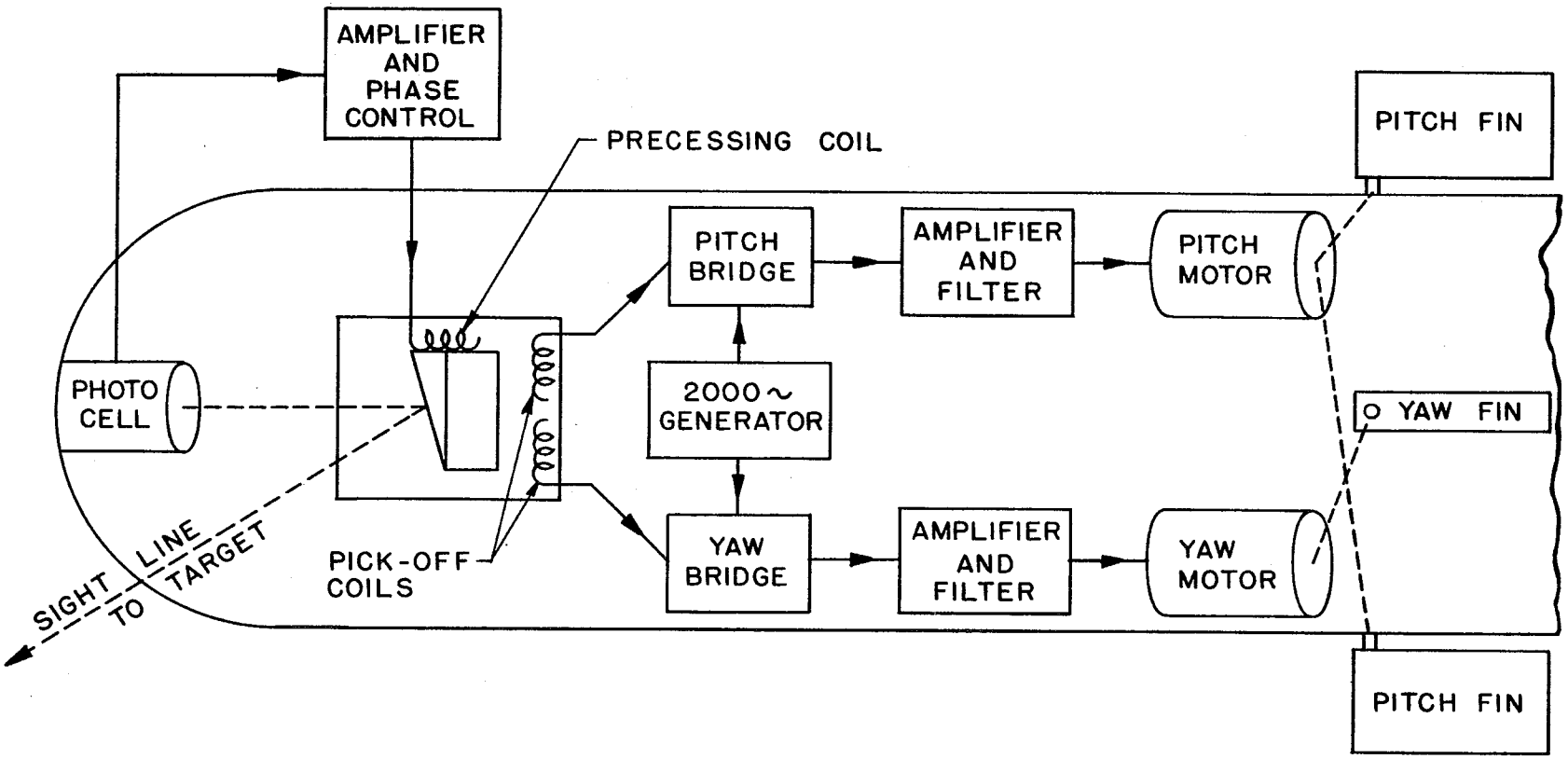
FIG. 7 is a diagrammatic view of a missile showing the various components of the guidance system in block form.
Figure 8:
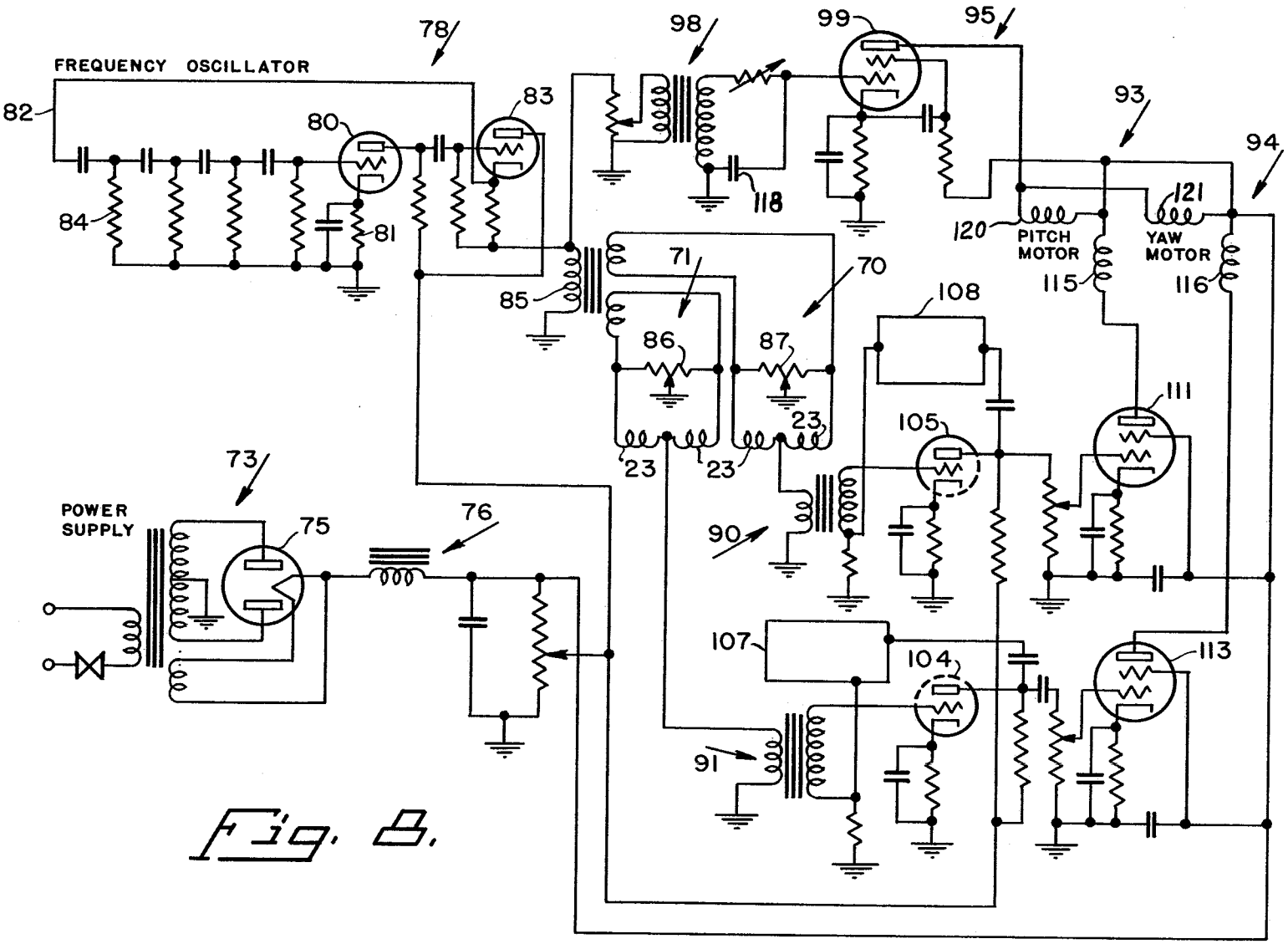
FIG. 8 is a wiring diagram of the phase discriminator and amplifier circuits controlling the missile servo motors.

The rotor 11 carries the permanent magnet 22 which rotates with the rotor. Bore 20 is formed in the magnet 22 as shown. The rotor 11 has a depending skirt 25, as shown, so that an annular space is formed between the skirt and the magnet. The fixed precessing coil 19 is solenoid coil disposed in this annular space, mounted on frame 16 by supports not shown, leaving the rotor free to tilt through a substantial angle. Disposed below the skirt 25 in close proximity thereto are electrical pick-off coils 23 which are used in measuring the tilt of the gyro rotor by variations in their inductance. The depending skirt 25 provides a return magnetic path for the magnetic flux of permanent magnet 22 and its relative proximity to the pick-off coils 23 determines their inductance. These pick-off coils each comprise two windings in series and a plurality of them may be provided in the respective quadrants of the rotor. For simplicity, pick-off coils 23 are shown for a single plane of precession only and they are mounted on the gyro support frame 16. The pick-off coils 23 are shown by the way of example as one manner of sensing tilt of the rotor 11 and are exemplary of electrical or other means of sensing the degree of tilt without actual physical attachment thereof to the rotor. These coils control a servo-mechanism, such as shown in FIGS. 7 and 8, which may be used to adjust the control fins of a missile, for example, to guide the missile along a pursuit course to a target.

Figure 4:
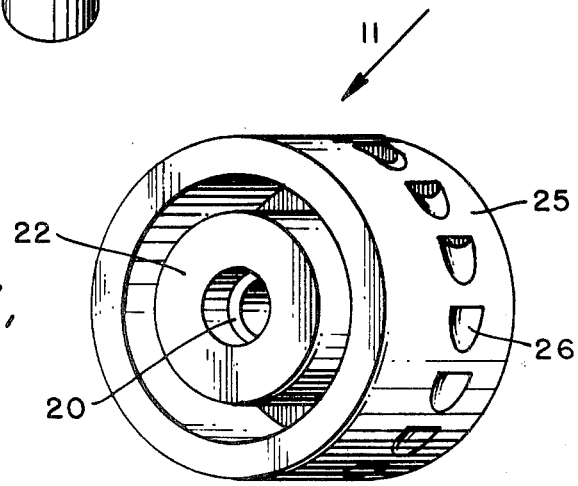
FIG. 4 is a view of the gyro rotor and permanent magnet.

Referring now to FIG. 4 of the drawings, this figure is a view of the rotor showing the permanent magnet 22 having a central bore 20 for mounting the rotor on its central pivot. The pivot point is located as near the center of gravity of the rotor as is practicable. Indicated at 26 are milled scallops around the periphery of the rotor and against which the air jets are directed for rotating the rotor.

Figure 5:
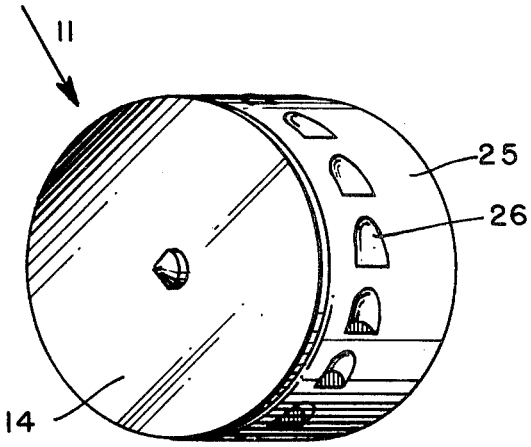
FIG. 5 is another view of the gyro rotor including the mirror.

Referring to FIG. 5, this figure is another view of the rotor including the mirror 14 which, as pointed out, for example, may be mounted at an angle of $2\frac{1}{2}°$ to the rotor axis. The mirror 14 is mounted at an angle so that its optical axis is at the same angle to the gyro axis causing the reflected image of a target to travel in a circular path when the gyro rotor 11 is rotating. The pivot 21 in the center of the rotor is shock mounted on gyro frame 16 to dampen out vibration.

Figure 6:
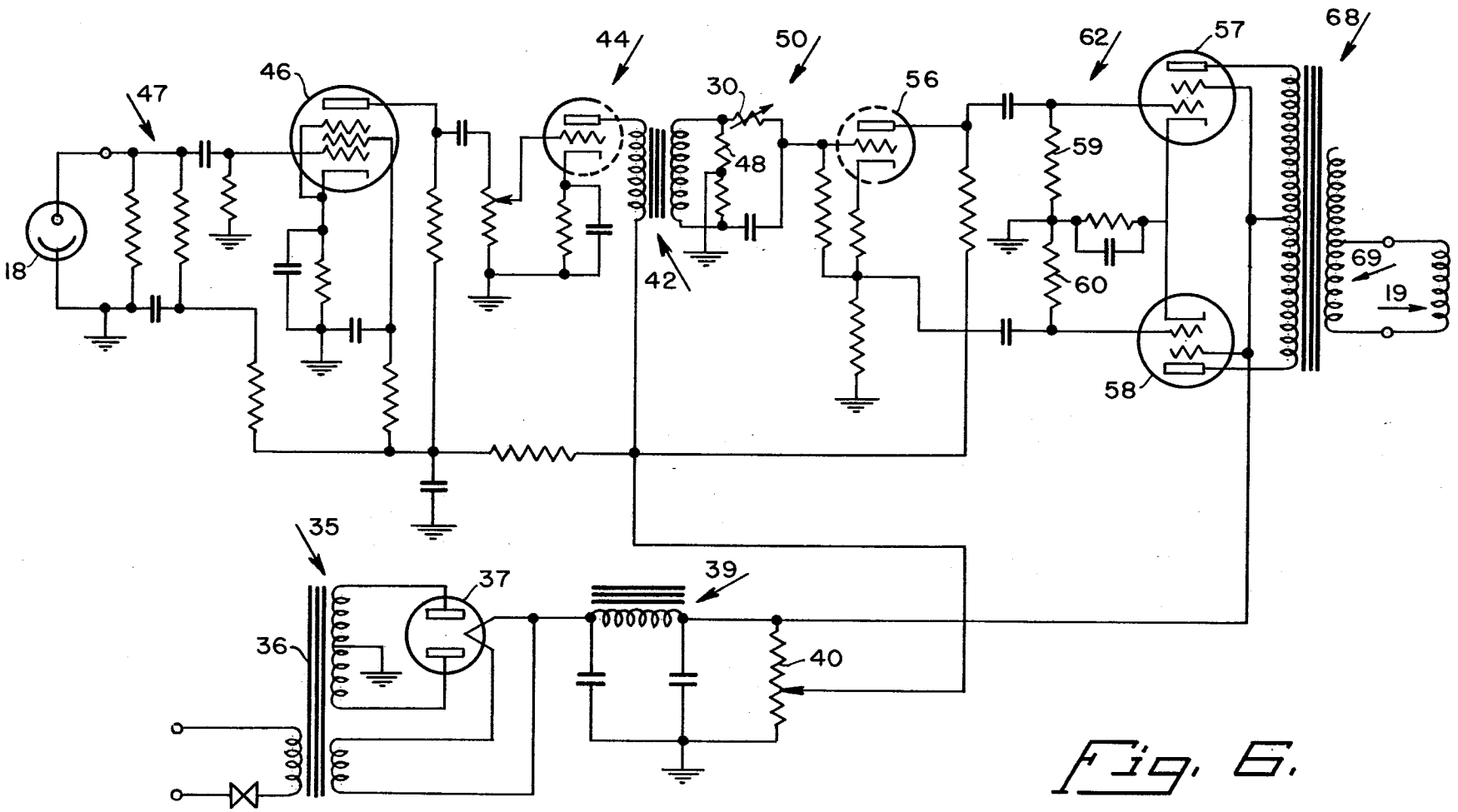
FIG. 6 is a wiring diagram of the photocell and precession amplifier.

Referring to FIG. 6, this figure shows a wiring diagram of the precessing amplifier which amplifies the photocell signal and feeds it to precessing coil 19.

It will be appreciated that by properly relating the tilt of the reflecting mirror 14 to the poles of the permanent magnet 22, the signal generated when the gyro axis does not coincide with the line of sight from the seeker to the target can be applied to the coil 19 for producing a magnetic field at the instant the poles of the magnet are so disposed that interaction between the magnetic fields of the coil and the magnet will give a torque which causes the gyro to precess itself in such direction as to align the gyro axis with the line of sight. However, to avoid the necessity of physically orienting the angle of mirror tilt exactly with respect to magnet poles in the fabrication of the gyro rotor, the phase angle of the output of the precessing amplifier of FIG. 6 may be shifted the amount necessary to cause current to flow through the precessing coil 19 at the time the orientation of magnet 22 is such that a torque will be developed which will cause gyro 11 to be precessed in the proper direction so that the angular difference or error between the gyro axis and the line of sight between the seeker device and the target will be eliminated. In operation, the effect of incorrect phasing is to cause the gyro to correct an error in pointing by spiraling to the new position, whereas, correct phasing adjustment is indicated when the rotor precesses in a straight line to the new position.

The precessing amplifier circuit includes a conventional power supply 35 including a transformer 36 having primary and secondary windings and a fullwave rectifier as shown at 37. Associated with the power supply 35 is a filtering network 39 of conventional form supplying a potentiometer 40. Potentiometer 40 supplies power to a phase shift transformer 42, the primary of which is in the plate circuit of amplifier tube 44. The photocell 18 is connected in the grid circuit of an amplifier tube 46 which is a five element tube having screen and suppressor grids as shown. The input circuit of tube 46 includes photocell 18 and filter circuits 47 to limit the range of frequencies to which the system will be sensitive.

The output of tube 46 is connected to the control grid of tube 44 which controls the primary of transformer 42.

The secondary of transformer 42 connects to a conventional phase shifting circuit network as shown at 50 including a center tapped resistor 48 connected across the secondary and grounded, and a manual rheostat 30. By adjustment of rheostat 30 the phase of the signal pulses being transmitted can be adjusted. The phase shifting circuit 50 is connected to a phase splitting tube 56, the output of which connects to a push-pull power amplifier circuit 62. Circuit network 62 includes push-pull connected tubes 57 and 58. Numerals 59 and 60 indicate grid resistors for tubes 57 and 58.

The power amplifier network 62 is connected to the primary of output transformer 68 and the secondary 69 of this transformer is connected to the gyro precessing coil 19.

By adjusting the variable resistor 30, the phase, or time of occurrence, of the pulses from photocell 18 can be adjusted relative to the angular position of the north-south pole axis of the permanent magnet 22 so that the direction of precessing is such as to achieve straight line precession of the gyro in realigning its axis with the line of sight from the seeker device to the target.

The pick-off coils 23 are connected to phase discriminators included in amplifier channels controlling servo-motors which adjust the fins of the missile. By way of example, there may be a pitch motor and a yaw motor, each controlled by pairs of pick-off coils to control the missile in pitch and yaw. FIG. 7 is a diagrammatic view of a complete missile seeker-head with the various components shown in block form. FIG. 8 is a wiring diagram showing the phase discriminator-amplifier channels connected to the pitch motor and yaw motor. In FIG. 8 the phase discriminator channels are indicated at 70 and 71. These circuits include Wheatstone bridges having the pick-off coils 23 forming legs thereof. The impedance of the coils 23 controls the balance or unbalance of the bridge, as will presently be described.

In FIG. 8 there is shown a conventional power supply at 73 which may be powered from a 110 volt 60 cycle source. The power supply includes a conventional fullwave rectifier as shown at 75 and a filtering network 76. The power supply feeds a 2,000 cycle oscillator 78 of conventional type including three element tubes 80 and 83 and a cathode resistor 81. Numeral 82 indicates a feedback circuit, the grid circuit including a parallel T filter network 84 necessary to establish and maintain the oscillation frequency of 2,000 cycles. The oscillator 78 supplies power to a transformer 85, which, in turn, supplies power to the yaw bridge 71 and the pitch bridge 70 and also to transformer 98. These bridges have the pick-off coils forming legs thereof, as described and potentiometer balance as shown at 86 and 87. The bridges connected to the primaries of transformers 90 and 91 included in the channels respectively to the pitch motor 93 and yaw motor 94. Pitch motor 93 and yaw motor 94 are split phase motors, each having a winding connected to a fixed phase motor amplifier 95, which is supplied with power from transformer 98 as shown. It should be noted that condenser 118 is provided to make the currents in windings 120 and 121, supplied by amplifier 95, 90 electrical degrees away from the currents in windings 115 and 116. Amplifier 95 includes a four element tube 99. Each of the servo motor channels includes an amplifier tube, such as the tube 105, connected to the secondary of the transformer 90. Across tube 105, which is the high gain stage, is a feedback provided by a parallel T, RC filter 108 tuned to 2,000 cycles. A frequency widely separated from that of the precessing coil is used in the servo loops to isolate them. The output of this circuit is further amplified by an amplifier stage 111 connected to one of the windings such as the winding 115 of the pitch motor 93. In the operation of one of the channels any unbalance, as between the pick-off coils 23, will unbalance the bridge circuit, 70, for example, causing the current to flow in the primary of transformer 90 having a phase dependent on the direction of the unbalance. This will result in a signal in the channel 90 which will be amplified and will be impressed on the windings 115 of the pitch motor 93 which will cause this motor to rotate in the proper direction to adjust the fins controlled thereby to adjust the missile to the proper heading in elevation. The other channel 71, 91, 104, 107, 113 and 116 similarly controls the yaw motor 94 to similarly control the missile heading in azimuth.

From the foregoing, it can be seen that signals are generated in the pick-off coils 23 depending on tilt of the gyro rotor 11, and that such signals result in controlling the missile fins, by means of a network as shown in FIGS. 7 and 8, to guide the missile so that the gyro axis and the longitudinal axis of the missile substantially coincide. This results in the missile following a pursuit course to the target.

Referring now to the overall operation of the system, the photocell 18 is mounted on the longitudinal axis of the seeker device, and the gyro rotor 11, as described, is rotated by air or other gas which is discharged from the jets 13 in manifold 12 and which impinges on scallops 26 on the rotor. As the mirror 14 rotates with the gyro rotor it scans an area which includes a target, target 17, FIG. 1 for example. The reflected target image appears at the photocell as a small dot of light rotating in a circular path at the spin frequency of the gyro. As long as the circular path traveled by the reflected image of the target surrounds the sensing area, the photocell 18, there will be no signal produced by the photocell. However, if there is an angular difference or error between the gyro axis and the line of sight from the target seeker device to the target, the circular path traveled by the reflected image of the target will cross the sensing area of the photocell producing a signal the frequency of which equals the spin frequency of rotor 11. The inner diameter of the circle formed by the rotating image is adjusted so that a slight displacement of the path of the image of the target at photocell 18 due to an error between the gyro axis and the line of sight from seeker device to the target (i.e., an angular difference between the gyro axis and the line of sight) will result in the sensing area of the photocell being touched by the rotating image to produce a signal at the spin frequency. This signal from the photocell is fed to the precessing amplifier where it is amplified and then applied to the precessing coil so that a magnetic field is generated by the precessing coil. This field produced by the precession coil when the image of the target crosses the photocell interacts with the magnetic field of the permanent magnet carried by the gyro rotor. The signal from the photocell will be in the form of pulses the time of occurrence of which, or phase, will vary with the direction of the error between the gyro axis and the line of sight to the target.

Figure 10:
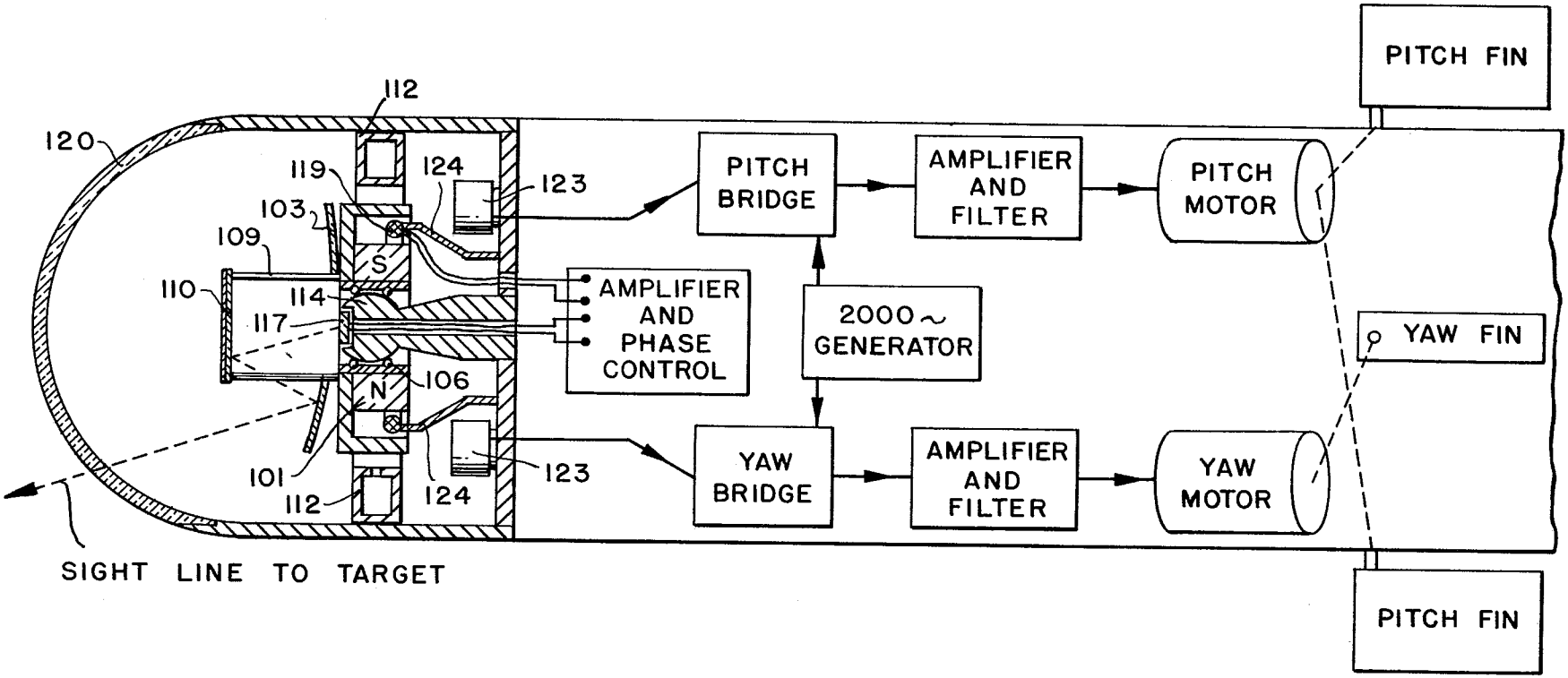
FIG. 10 is a view as in FIG. 9 in combination with a diagrammatic view in FIG. 7, showing a preferred embodiment of the invention.

The poles of the permanent magnet carried by the gyro rotor have a fixed orientation as respects the position of maximum tilt of the mirror. Thus, the time of the maximum amplitude of the signal impulse from photocell 18, and hence the maximum magnetic field of the precession coil 19, will occur at the time that the permanent magnet is in the position that the torque developed will cause the gyro to precess to realign its axis with the line of sight to the target. In other words, the permanent magnet mounted on the gyro rotor, and the coacting precession coil energized in accordance with a single-channel signal which exhibits a pulse at a given time in each 360° spin of the gyro rotor, operate to precess the gyro in a certain definite direction relative to the initial orientation of the spin axis, a direction corresponding to the particular cyclic instant at which the pulse occurs. In other words, the rotatable magnet on the rotor establishes a first magnetic force vector of fixed magnitude rotatable about the spin axis of the gyro at a frequency corresponding to the rate of rotation of the gyro rotor. The precessing coil (solenoid) when energized with the signal from the photocell produces a second magnetic force vector in the direction of the missile axis which is variable in magnitude in accordance with the displacement of the radiation source (target) with respect to the gyro spin axis and in time phase relationship with the polar angular position of said radiation source in relation to the first vector produced by the permanent magnet. When the signal current flows in the precessing coil, a variable magnet field is generated having the same frequency as the rotational frequency of the gyro rotor. In this manner the device operates to continuously track the target, the axis of the gyro being precessed in space as necessary so as to always point at the target. It can be seen that the direction of this precession is determined solely by the relative positions of the target, mirror, and magnet and is thus independent of missile orientation in roll, within the limits of freedom of gyro rotor 11. FIG. 9 shows a modification of FIG. 1 in which the seeker head keeps the target in view when the missile oscillates; it is independent of missile orientation in roll, pitch or yaw within the limits of freedom of the gyro rotor. FIG. 10 shows an embodiment as in FIG. 9 wherein the detector cell 117, precession coil 119 and pick-off coils 123 are shown electrically connected to the phase discriminator and amplifier circuits which control the missile.

In the foreging, the angle of mirror tilt has reference to the diameter of the mirror representing the position of maximum tilt. Physically, of course, this particular diameter has a fixed position relative to the axis of the north and south poles of the magnet 22. The variable phase shift provided in the precession amplifier makes it unnecessary to actually physically adjust the angle between the mirror and the north-south pole axis of the magnet to secure straight line precessing. The phase adjustment is provided in a circuit component of the precession amplifier between two of the amplification stages. This component is a conventional type of phase shifting network manually controllable by an adjustable resistor, as shown at 30 in FIG. 6. Thus, by adjusting this resistor the relationship between the signal from photocell 18 and the north-south pole axis of the magnet is adjusted to achieve the desired precession. Precession of the gyro in the proper sense to realign its axis with the sight line to the target may be understood from the principle of the gyro, that with rotation about a first axis, a torque applied about a second axis will cause the gyro to precess about a third axis, all of the axes being normal to each other. Thus, with the north-south magnet axis in a given position, a torque applied from a signal in the proper phase position will result in precession in the proper direction to achieve the desired motion of the gyro axis.

The pick-off coils as shown at 23 are utilized to sense or measure the tilt, the amount the missile has moved from alignment with the gyro axis. These coils, as described, are mounted directly beneath the skirt of the rotor, and a position signal is derived from them by variation in their inductance, depending upon their proximity to the rotor skirt. These coils are connected to feed a signal to the amplifier (FIG. 8). The amplifier in response to the position signals controls the servomotors 93 and 94 to move the fins and guide the missile on a pursuit course to the target.

From the foregoing, it will be observed by those skilled in the art that a relatively simple but yet rugged and effective weapon is provided which is operable to "lock on" a radiating target and after being fired will continuously track the target while travelling on a pursuit course until the target is overtaken and destroyed.

Referring to FIG. 9 of the drawings, this figure shows schematically a preferred form of the invention calculated to realize certain advantages. In the first form of the invention a gyro is utilized to establish and maintain the longitudinal axis of the seeker device on the line of sight to the target which is a reference line, and a pursuit course is navigated along this reference line by causing the missile to follow the gyro. In the first form, FIG. 1, the photosensitive device is carried by the transparent nose 10 of the missile. The preferred embodiment of the invention involves an arrangement of parts including particularly an assembly of the optics and the photocell in such a way that the photocell is mounted on the bearing about which the gyro rotor rotates and precesses. In FIG. 9 the gyro rotor is indicated at 100 and it comprises a permanent magnet 101 as in the first embodiment; it also has a skirt 102 providing a return magnetic path. Precessing coil 119 is mounted on base 122 by supports 124. Numeral 114 designates a fixed central bearing support for the gyro rotor which is in the form of a spherical ball and the rotor is mounted to move universally about this ball, the central bore of the rotor engages ball bearings 106 which are positioned between the central bore and the spherical ball 114. Fixed spherical ball and central support and spherical ball 114 is mounted on base 122. The rotor carries a tilted concave mirror 103 and numeral 109 designates support rods to which is attached plane or convex mirror 110 on the axis of the rotor mounting. The photocell, or radiant energy sensitive element 117 such as a lead sulfide cell, is mounted on the spherical ball 114 on the axis of rotation of the gyro. However, photocell 117 is on the fixed support and does not rotate or move with the gyro. The mirror assembly rotates with the gyro rotor and moves therewith. Infrared radiation, for example, from a target passes through the transparent nose 120 of the seeker head and is reflected off concave mirror 103 and plane mirror 110. The mirror assembly on the gyro lines up with the line from the seeker to the target and the reflected target image surrounds the photocell. If the gyro axis deviates from pointing to the target the reflected radiation from the target will impinge on the photocell to produce a signal which is fed to the precessing amplifier, as described in the foregoing and shown in FIGS. 7 and 10, and cause the gyro to be precessed in a straight line by precessing coil 119 so that the gyro axis will realign with the line to the target. When the gyro axis does not coincide with the longitudinal axis of the missile (i.e., the longitudinal axis of the target seeker device) the gyro rotor is tilted. The amount the rotor has tilted is sensed by the pick-off coils 123, which are mounted behind the rotor skirt, by variation in their inductance caused by their proximity to the rotor skirt. The pick-off coils are connected to an amplifier (see FIGS. 7 and 10) where the rotor position signals are amplified and used to control servo motors which guide the missile so that the longitudinal axis of the missile and the gyro axis will coincide and the missile will follow a pursuit course to the target.

Obviously, many modifications and variations of the present invention are possible in the light of the above teachings. It is, therefore, to be understood that within the scope of the appended claims the invention may be practiced otherwise than as specifically described.

What is claimed is:

1. In a guided missile having control surfaces, a radiation-responsive gyro-stabilized target seeking device mounted in the forward end of the missile, comprising in combination, a housing structure, a gyro having a rotor, a universal pivoting mount carried by said housing structure for supporting said gyro for rotational movement about an axis of spin and for universal swiveling movement on said mount, drive means for rotating said gyro rotor, scanning means including the combination of optical means mounted on and rotating with the rotor and a non-rotating radiation sensitive means carried by said gyro mount for producing an electrical signal, said electrical signal resulting from a light image from a target falling within the field of view of the optical means of said scanning means and being transmitted thereby to said radiation sensitive means, a permanent magnet carried by and forming a portion of said rotor for rotation therewith, the axis passing through the poles at opposite ends of said permanent magnet intersecting the spin axis of said rotor, means comprising electrical windings mounted in said housing structure for producing a magnetic field in response to said electrical signal, said electrical windings mounted in a position such that the magnetic field produced therein interacts with the magnetic field of the permanent magnet of the rotor to produce a precessing torque upon the gyro rotor, means for adjusting the time phase position of said electrical signal with respect to the position of said permanent magnet so that the precessing torque produced by the interaction of said magnetic fields has a sense that will precess the gyro rotor in a manner to align its spin axis to point at the target; position sensing means mounted in said housing structure in a position for sensing the position of said gyro rotor and servo means responsive to signals from said position sensing means for controlling movement of said control surfaces and thus the course of the guided missile.

2. In a radiation responsive homing device, in combination, a housing structure, a gyro having a rotor, a universal bearing mount supporting said gyro and carried by said housing structure, means for rotating said gyro rotor, scanning means including the combination of an optical element mounted on and rotating with the rotor and a non-rotating radiation sensitive means mounted on said gyro mount for producing an electrical signal, said electrical signal resulting from a light image from a target falling on the optical element of said scanning means and being transmitted thereby to said radiation sensitive means, a permanent magnet carried by and rotating with the rotor, means comprising an electrical winding mounted on said housing structure near said permanent magnet for producing a magnetic field in response to said electrical signal, said magnetic field interacting with the magnetic field of the permanent magnet to produce a precessing torque upon the gyro rotor, means for adjusting the time phase position of said electrical signal with respect to the position of said permanent magnet so that the precessing torque produced by the interaction of said magnetic fields has a sense that will precess the gyro rotor in a manner to align its axis to point at the target.

3. In a guided missile, an air frame having a longitudinal axis, a target seeking device carried by said air frame comprising a gyroscopically stabilized means mounted for rotational movement about an axis of spin forming a first coordinate axis to optically scan a limited region about said axis of spin for electromagnetic radiations emanating from a target source, said means including a permanent magnet rotor having magnetic poles defining a second coordinate axis transverse to said axis of spin, a radiation sensitive means for producing electrical signal variations in response to variations in radiation incident on said radiation sensitive means, said radiation sensitive means being fixedly positioned relative to said scanning means for receiving said radiations from said scanning means to cause said electrical signals generated thereby to vary in magnitude with the directional displacement of said target with respect to said first coordinate axis and in time phase with the polar angular position of said target with respect to the second coordinate axis, windings fixedly supported on said missile air frame, and means for applying said electrical signals to said windings to produce a magnetic field acting upon said permanent magnet causing said gyroscopically stabilized means to precess through an angle and in a direction to bring said axis of spin into directional alignment with said target source.

4. In a guided missile, an air frame having a longitudinal axis, a target seeking device carried by said air frame comprising a gyroscope rotor mounted for rotational movement about an axis of spin and for universal swiveling movement about a point on said missile axis, the said axis of spin is free to point in any direction in space within a cone circumscribed by movement of said axis of spin about said point, an optical means on said rotor for scanning a limited region about said axis of spin for electromagnetic radiations emanating from a target source, the gyro rotor including a permanent magnet having its magnetic poles defining a coordinate axis transverse to said axis of spin, a radiation sensitive element for producing electrical signals variable in response to variations in incident radiation, said sensitive element being fixedly positioned on the axis of said missile to receive radiations from said optical scanning means to cause said signals to vary in magnitude with the directional displacement of said target with respect to said axis of spin, and in time phase with the polar angular position of said target with respect to the said coordinate axis, windings fixedly supported on said missile air frame within the magnetic field of said permanent magnet and with its axis coincident with the said missile axis, and means for energizing said windings with said electrical signals producing a magnetic force upon said gyroscope rotor and having a component normal to said axis of spin and in a direction causing said gyroscope to precess about the point through an angle and in a direction to bring said axis of spin into directional alignment with said target source.

5. The combination of guided missile structure defined in claim 4 wherein said last named means includes means for adjusting the time phase of said signal with respect to said coordinate axis.

6. A seeker for sighting on an object which is remote from the seeker and gives off optical radiant energy comprising: a mounting, a gyro rotor, a universal bearing on which the rotor is mounted on the mounting so that the axis of rotation of the rotor can be precessed, a reflecting mirror mounted on and rotatable with the rotor, means for directing some of the radiant energy from the object to the mirror for reflection from the rotating mirror, a cell fixed relative to the mounting and in proximity to and responsive to the reflection from the mirror, the reflecting surface of the mirror being eccentric with respect to the axis of rotation of the rotor, whereby the reflection describes a path which does not move across the cell when the axis of rotation of the rotor is sighting on the object, and which moves across the cell when said axis is not sighting on the object, and means responsive to the cell, when the reflection moves across the cell, for precessing the rotor, whereby when the axis of rotation is directed away from the object the radiant energy reflected from the mirror moves across the cell during each revolution of the rotor to produce precession of the rotor in the direction which moves the axis of rotation toward the object.

7. A seeker according to claim 6 in which the said path is annular.

8. A seeker for pointing toward a target which is remote from the seeker and emits optical radiant energy, comprising: a mounting, a gyro rotor, a universal bearing held on the mounting, the rotor being rotatable on the bearing, optical means mounted on the rotor and exposed to the radiant energy for bringing some of the radiant energy to a focus, a cell held on the mounting and located in proximity to the focus and responsive to the radiant energy, said optical means being non-coaxial with respect to the axis of rotation of the rotor, whereby the focus describes a path which does not cross the cell when the axis of rotation of the rotor points toward the target, and which crosses the cell when the axis of rotation does not point toward the target, and means responsive to the cell, when the focus crosses the cell, for precessing the rotor, whereby when the axis of rotation is directed away from the target, the radiant energy from the optical means crosses the cell during each revolution of the rotor to produce precession of the rotor in the direction which moves the axis of the rotor toward the target.

9. Apparatus according to claim 8 in which the rotor has attached to it an air impeller, and a supply of air under pressure for driving the impeller to rotate the rotor.

10. Apparatus according to claim 8 in which the means responsive to the cell comprises a magnet on the rotor and a precession coil related to the magnet and means impressing electrical energy on the coil in response to the cell.

11. A seeker for directing the axis of travel of a vessel toward a target which gives off optical radiation, comprising: a mounting, a gyro rotor, a universal bearing fixed relative to the mounting, and on which the rotor is mounted so that the axis of rotation of the rotor can be precessed, a reflecting mirror fixed on the gyro rotor and adapted to reflect a beam from the radiation, means for directing the optical radiation to the mirror for reflection of a beam therefrom, a cell fixed relative to the mounting and responsive to the reflected beam from the mirror and located in proximity to the reflected beam, the reflecting surface of the mirror being non-collinear with the axis of rotation of the rotor, whereby the reflected beam describes a path which does not cross the cell when the axis of rotation of the rotor points to the target, and which crosses the cell when the axis of rotation does not point to the target, and means responsive to the cell, when the reflected beam crosses the cell, for precessing the rotor, whereby when the axis of rotation is directed away from the target, the beam reflected from the mirror crosses the cell during each revolution of the rotor to produce the precession of the rotor in the direction which brings the axis of the rotor toward the target, a magnet on the rotor having oppositely located north and south poles and a precession coil fixed relative to the mounting and in magnetic relation to the magnet.

12. Apparatus according to claim 11 in which the north and south poles on the magnet are spaced 180° apart.

13. A device for tracking a source of radiation, said device comprising a free spinning permanent magnet and a scanner fixed thereto in predetermined relation, means responsive to said scanner indicative of non-alignment of the axis of spin of said magnet with said source of radiation, and means responsive to said last-named means for producing a magnetic field which reacts with said magnet to apply a torque thereto for precessing the same and aligning the axis of spin thereof with said source of radiation.

14. The device of claim 13, wherein said scanner comprises a concave mirror.

15. The device of claim 13, wherein said last-mentioned means comprises a coil substantially concentric with said axis of spin of said magnet.

16. The device of claim 13, wherein said means responsive to said scanner comprises a photocell.

17. A device for tracking a source of radiation, said device comprising free spinning means having a spin axis normally coincident with a sight line from said means to said source of radiation, scanning means carried by said spinning means and rotatable therewith, means responsive to said scanning means adapted to generate a single signal during each resolution of spin when said sight line deviates from coincidence with said spin axis, and means responsive to said signal for applying a single torque to said spinning means for precessing the same to bring the spin axis thereof into coincidence with the deviated sight line.

18. The device of claim 17, wherein said scanning means comprises a concave mirror.

19. The device of claim 17, wherein said means responsive to said signals comprises magnetic means carried by said spinning means and magnetic means fixedly mounted adjacent thereto.

20. The device of claim 19, wherein said first-named magnetic means comprises a magnet having a polar axis disposed transverse of said spin axis, and said last-named magnetic means comprises a coil substantially concentric with said spin axis.

21. A seeker for tracking an object emitting radiant energy, said seeker comprising a single bearing member, gyroscopically stabilized means mounted for universal rotational movement on said single bearing member, radiation sensitive means fixedly related to said single bearing member and adapted to generate signals when radiant energy falls thereon, said first-named means including scanning means for directing some of said target radiant energy adjacent said radiation sensitive means when the rotational axis thereof is disposed in coincident relation with a sight line from the seeker to said object, displacement of said sight line from said coincident relation causing some of said directed radiant energy to fall upon said radiation sensitive means and thereby generate signals, and means responsive to said signals for applying a torque to said first-named means for precessing the same in a direction to bring the rotational axis thereof into said coincident relation with the displaced sight line.

22. The seeker defined in claim 21, wherein said scanning means comprises a concave mirror mounted eccentrically with respect to said rotational axis.

23. The seeker defined in claim 21, wherein said means responsive to said signals comprises a precession coil energized by said signals and mounted on said support in proximity to said first-named means.

24. The seeker defined in claim 23, wherein said first-named means comprises a permanent magnet having a polar axis disposed transverse of said rotational axis, said magnet rotating with said first-named means and interacting with said energized precession coil to precess said first-named means.

25. In a guided missile adapted to home on a target which emits radiant energy, an airframe, a single bearing member fixed to said airframe, a rotor mounted on said single bearing member for universal rotational movement, a radiation sensitive means fixed to said airframe and adapted to generate signals when radiant energy impinges thereon, scanning means mounted on said rotor and rotatable therewith for directing some of the radiant energy from said target to points adjacent said radiation sensitive means when the axis of rotation of said rotor is disposed in coincident relation with a sight line from the rotor to the target, displacement of said sight line from said coincident relation causing some of said directed radiant energy to impinge upon said radiation sensitive means and thereby generate signals, means responsive to said signals for precessing said rotor in a direction to bring said axis of rotation into said coincident relation with the displaced sight line, and means responsive to the precession of said rotor for orienting said missile with respect to said target.

26. In a guided missile, a device for tracking a target, said device comprising a gyro stabilized rotor wholly supported for universal rotational movement on a single bearing located on the axis of the missile, means for generating an electrical signal when the gyro axis is out of alignment with a line from said rotor to said target, and means utilizing said signal unresolved into components for applying a torque to said rotor for causing precession thereof in a direction to align said gyro axis with said line; whereby said rotor is precessed in accordance with said signal and such precession is independent of missile orientation in roll.

27. In combination, a gyro-stabilized target seeking device for tracking a remote field, said device including gyroscopic means rotating about an axis and having a line of sight to said field, scanning means carried by said gyroscopic means and adapted to produce a signal when said line of sight deviates from alignment with the axis of said gyroscopic means, and means responsive to said signal for applying a single precessing torque to said gyroscopic means in a direction to precess said gyroscopic means so as to align the axis of said gyroscopic means with said line of sight to said field.

28. A gyroscopically stabilized system capable of being precessed in any direction to follow a field by means of a single electrical signal which is unresolved into components and thus is independent of any rotation of supporting structure, comprising, in combination, gyroscopic means mounted on a single pivot bearing, means for producing an electrical signal, and means utilizing said signal unresolved into components for applying a single precessing torque to said gyroscopic means in a direction to align the axis of the gyroscopic means with the line from said gyroscopic means to said field.

29. A gyroscopically stabilized radiation seeking apparatus which can be precessed in any direction to follow a source of radiation by means of a single electrical signal which is unresolved into components and thus is independent of any rotation of the supporting structure, comprising, in combination, a radiation responsive device gyroscopically stabilized and having a gyroscope with a rotor, scanning means for scanning radiation and including a radiation reflecting element carried by said rotor and centered thereon, said scanning means including means for producing a signal when the line of sight to said source of radiation deviates from alignment with the axis of said gyroscope, and means responsive to said signal for applying a single precessing torque to said gyroscope to realign the center of said reflecting element with the line of sight to the source of radiation.

30. In combination, a gyroscopically stabilized apparatus having a rotor mounted for rotation about a single pivot bearing, signal generating means non-rotatably mounted on said bearing, means carried by said rotor for projecting radiation to said signal generating means, said signal generating means being operative to generate a signal proportional to the displacement of the rotor axis from a desired line of sight and having a time phase proportional to the polar angular position of the rotor about its axis, and means responsive to said signal for precessing said rotor in a direction to realign the axis thereof with said line of sight.

31. A field responsive seeking gyroscope system, comprising, a free spinning device for scanning and detecting a source of radiation the direction of which is to be determined and for providing unresolved error output signals representative of misalignment of the axis of rotation of said free spinning device with respect to said source of radiation; and means for receiving said unresolved error output signals and utilizing them to precess said free spinning device through gyroscopic forces to cause said axis of rotation of said free spinning device to align itself with said direction of said source of radiation.

32. A device for indicating the direction of an energy radiating source by the alignment of an axis of symmetry of said device with a sight line to said source, comprising, a spinning body, the spin axis of which constitutes the axis to be aligned with said sight line, detecting means carried by said spinning body and located about the spin axis thereof, means for directing radiation emanating from said source upon said detecting means which passes through a limited field of view centered about the spin axis of said spinning body, means connected to said detecting means for sensing an asymmetrical exposure of said detector to radiation and providing an output upon occurrence of asymmetrical exposure, and means responsive to the output of said sensing means for providing a torque acting upon said body perpendicular to said spin axis whereby said spin axis is precessed into alignment with the sight line to said source.

33. A scanning and tracking system for use with a spinning body for adjusting its attitude with respect to a distant source of radiation, comprising, means mounted on said spinning body for scanning and detecting said source of radiation and for giving output signals representative of the position of said source of radiation, and means for receiving said output signals and utilizing them to precess said spinning body through gyroscopic forces to allow said scanning and detecting means to align itself with said source of radiation so that said body can adjust its attitude with respect to said source of radiation.

34. A gyro stabilized telescope system which can be precessed in any direction to follow a source of radiation by means of a single electrical signal which is unresolved into components and is hence independent of rotation of supporting structure, comprising, gyro means mounted on a single central pivot bearing, and means for applying a single precessing torque to said gyro means, the vector direction of said torque being in the plane established by the spin axis of said gyro means and the line from said gyro means to said source of radiation, whereby said gyro means precesses in a direction to align its axis with the line to said field.

35. A gyro stabilized apparatus which can be precessed in any direction to follow a source of radiation by means of a single electrical signal which is unresolved into components and is hence independent of rotation of the gyro supporting structure, comprising, a radiation responsive device gyroscopically stabilized along the line of sight having a gyroscope with a rotor, scanning means for scanning radiation emanating from a source of radiation including a radiation reflecting element carried by said rotor and centered thereon, said scanning means including a device to generate a signal when the line of sight deviates from alignment with the gyro axis, and means responsive to the signal to apply a precessing torque to said gyro having a sense to precess said gyro so as to realign the center of said reflecting element and gyro axis with the line of sight to said source.

36. In combination, a gyroscopically stabilized telescope having a gyro with a rotor mounted for rotation about a single central pivot, signal generating means, a system carried by said gyro rotor for projecting radiation to said signal generating means, said signal generating means being nonrotatably mounted on said central pivot and operative to generate a signal proportional to the displacement of the gyro rotor axis from a desired line of sight, with the time phase of said signal being proportional to the polar angular position of said rotor about its axis, and means responsive to said signal for realigning said gyro rotor axis with the line of sight by precessing said gyro in a direction to effect said realignment.

37. In combination in a missile guidance system, a target seeking apparatus having radiation responsive means including a scanner, a gyroscope having a rotor, said scanner being mounted on said rotor for picking up radiation from a target, means for precessing said gyroscope rotor to align its axis with the sight line to said target, said radiation responsive means producing a signal when the gyroscope rotor axis deviates from alignment with the sight line to said target, said signal having a time phase dependent on the radial direction of departure of said target from the gyro rotor axis, the precessing means embodying mechanism responsive to the phase of said signal whereby said gyro is precessed in the proper sense to align its axis with the line of sight to said target, a position sensing means included in said target seeking apparatus and mounted adjacent said gyro rotor for sensing the position of said gyro rotor, and servo means responsive to signals from said gyro rotor position sensing means for guiding said missile.

38. A target seeking device for a guided missile comprising a gyroscopically stabilized means for optically scanning a limited region about a first coordinate axis for electromagnetic radiations emanating from a target source, said means including a permanent magnet rotor rotatable with said gyroscopic means about said first axis, the magnetic poles of said permanent magnet defining a second coordinate axis transverse to said first coordinate axis, a radiation sensitive means for producing electrical signal variations in response to variations in radiation incident on said radiation sensitive means, said radiation sensitive means being fixedly positioned relative to said scanning means for receiving said radiations from said scanning means to cause said electrical signals generated thereby to vary in magnitude with the directional displacement of said target with respect to said first coordinate axis and in time phase with the polar angular position of said target with respect to the second coordinate axis, and means interacting with said permanent magnet rotor responsive to said signal for applying a magnetic force to said gyroscopically stabilized means having a component normal to said second axis and in a direction causing said gyroscopically stabilized means to precess through an angle and in a direction to bring said first coordinate axis into directional alignment with said target source.

* * * * *